US006485638B2

(12) United States Patent
Henkin et al.

(10) Patent No.: US 6,485,638 B2
(45) **Date of Patent: *Nov. 26, 2002**

(54) ELECTRIC POWERED AUTOMATIC SWIMMING POOL CLEANING SYSTEM

(76) Inventors: Melvyn L. Henkin, 1001 Sharon La., Ventura, CA (US) 93001; Jordan M. Laby, 1389 Beachmont, Ventura, CA (US) 93001

( * ) Notice: Subject to any disclaimer, the term of this patent is extended or adjusted under 35 U.S.C. 154(b) by 0 days.

This patent is subject to a terminal disclaimer.

(21) Appl. No.: 09/859,117

(22) Filed: May 15, 2001

(65) Prior Publication Data

US 2001/0032809 A1 Oct. 25, 2001

Related U.S. Application Data

(63) Continuation-in-part of application No. 09/440,109, filed on Nov. 15, 1999, now Pat. No. 6,294,084.

(51) Int. Cl.[7] ..... B01D 17/12

(52) U.S. Cl. ..... 210/143; 15/1.7; 15/319; 210/169; 210/241; 210/242.1; 134/18

(58) Field of Search ..... 210/97, 143, 169, 210/241, 242.1, 525, 739, 776, 800, 416.2; 15/1.7, 319; 134/18, 21, 22.1, 24, 166 R, 167 R, 168 R

(56) References Cited

U.S. PATENT DOCUMENTS 4,154,680 A * 5/1979 Sommer ..... 210/169
4,835,809 A * 6/1989 Roumagnac ..... 15/1.7
4,837,886 A * 6/1989 Rawlins ..... 15/1.7
4,849,024 A * 7/1989 Supra ..... 15/1.7
5,197,158 A * 3/1993 Moini ..... 15/1.7
5,337,434 A * 8/1994 Erlich ..... 15/1.7
5,435,031 A * 7/1995 Minami et al. ..... 15/1.7
5,985,156 A * 11/1999 Henkin et al. ..... 210/194
6,039,886 A * 3/2000 Henkin et al. ..... 210/776
6,090,219 A * 7/2000 Henkin et al. ..... 210/143
6,294,084 B1 * 9/2001 Henkin et al. ..... 210/143
6,365,039 B1 * 4/2002 Henkin et al. ..... 210/169
6,387,250 B1 * 5/2002 Henkin et al. ..... 210/97
6,498,878 * 6/2002 Henkin et al. ..... 15/1.7
6,412,133 B1 * 7/2002 Erlich et al. ..... 15/1.7

* cited by examiner

*Primary Examiner*—Joseph W. Drodge
(74) *Attorney, Agent, or Firm*—Freilich, Hornbaker & Rosen

(57) ABSTRACT

A system for automatically cleaning swimming pools includes a unitary body having a level control subsystem for selectively moving the body to a position either proximate to the surface of the water pool or proximate to the interior surface of the containment wall, a propulsion subsystem operable to selectively propel the body in either a forward or rearward direction, and a cleaning subsystem operable in either a water surface cleaning mode for skimming or scooping or a wall surface cleaning mode for vacuuming or sweeping. The subsystems are powered by an electric source such as solar cells and/or rechargeable batteries and/or a wire extending to the unitary body from an external power source. An alternative embodiment uses separate top and bottom units tethered together by an electric conduit.

17 Claims, 9 Drawing Sheets

ELECTRIC POWERED AUTOMATIC SWIMMING POOL CLEANING SYSTEM

RELATED APPLICATIONS

This application is a continuation-in-part (CIP) of U.S. application Ser. No. 09/440,109 filed Nov. 15, 1999, now U.S. Pat. No. 6,294,084.

FIELD OF THE INVENTION

The present invention relates to a method and apparatus for automatically cleaning a swimming pool.

BACKGROUND OF THE INVENTION

U.S. Pat. No. 5,985,156 describes apparatus including a unitary body having (1) a level control subsystem for selectively moving the body to a position either proximate to the surface of a water pool or proximate to the interior surface of a wall containing the water pool, (2) a propulsion subsystem operable to selectively propel the body in either a forward or rearward direction, and (3) a cleaning subsystem operable in either a water surface cleaning mode (e.g., skimming or scooping) or a wall surface cleaning mode (e.g., vacuuming or sweeping). The patent discloses that these subsystems can be powered by hydraulic, pneumatic, and electric power sources and specifically describes hydraulic embodiments powered by positive and negative water pressure.

Applicant's parent application Ser. No. 09/440109, now U.S. Pat. No. 6/294,084.(which is incorporated herein by reference) and this CIP application describe embodiments in which one or more of the aforementioned subsystems is powered by an electric source such as solar cells and/or rechargeable batteries and/or a wire extending to the unitary body from an external (e.g., deck mounted) power source. The batteries can be charged from solar cells carried by the unitary body or via an appropriately configured docking station. The described embodiments can use either a heavier-than-water body or a lighter-than-water body. When a heavier-than-water body is used, the body in its quiescent or rest state typically sinks to a position proximate to the bottom portion of the containment wall. In an active state, the level control subsystem produces a vertical force component for lifting the body to proximate to the water surface. When a lighter-than-water body is used, the body in its quiescent state floats at a position proximate to the water surface. In an active state, the level control subsystem produces a vertical force component for causing the body to descend to proximate the wall bottom portion.

SUMMARY OF THE INVENTION

The present CIP application introduces a further system embodiment which uses separate top and bottom units tethered together by a conduit in lieu of the unitary body heretofore described. The top unit functions to clean the water surface in a manner analogous to the unitary body when operating in the water surface mode and the bottom unit functions to clean the wall surface in a manner analogous to the unitary body when operating in the wall surface mode.

In accordance with the invention, at least one of the tethered top and bottom units includes a propulsion subsystem powered by an electric source such as solar cells and/or rechargeable batteries and/or a wire extending from an external power source.

In a preferred tethered units embodiment, the top unit includes a solar cell for charging an on-board battery. The battery powers a flow generator, e.g., a motor driven propeller, which produces a water flow for propulsion and water surface cleaning. The top unit preferably supplies electric power and/or control signals via the conduit to the bottom unit for powering a flow generator for propulsion and wall surface cleaning. The top and/or bottom units preferably include containers for collecting debris.

The conduit additionally functions to physically transfer forces between the top and bottom units so that the unit being propelled can pull the other unit along. In a preferred embodiment, the units are oppositely oriented so, for example, forward propulsion of the top unit pulls the bottom unit rearwardly. Similarly, forward propulsion of the bottom unit pulls the top unit rearwardly. This preferred orientation enables the tethered pair to readily avoid getting trapped behind an obstruction in the pool.

DETAILED DESCRIPTION

FIGS. 1A–6 hereof correspond to FIGS. 1–6 of parent application Ser. No. 09/440,109, now U.S. Pat. No. 6,294,084.

FIG. 7–10 hereof depict a further embodiment comprised of tethered top and bottom units.

Figure 1A:
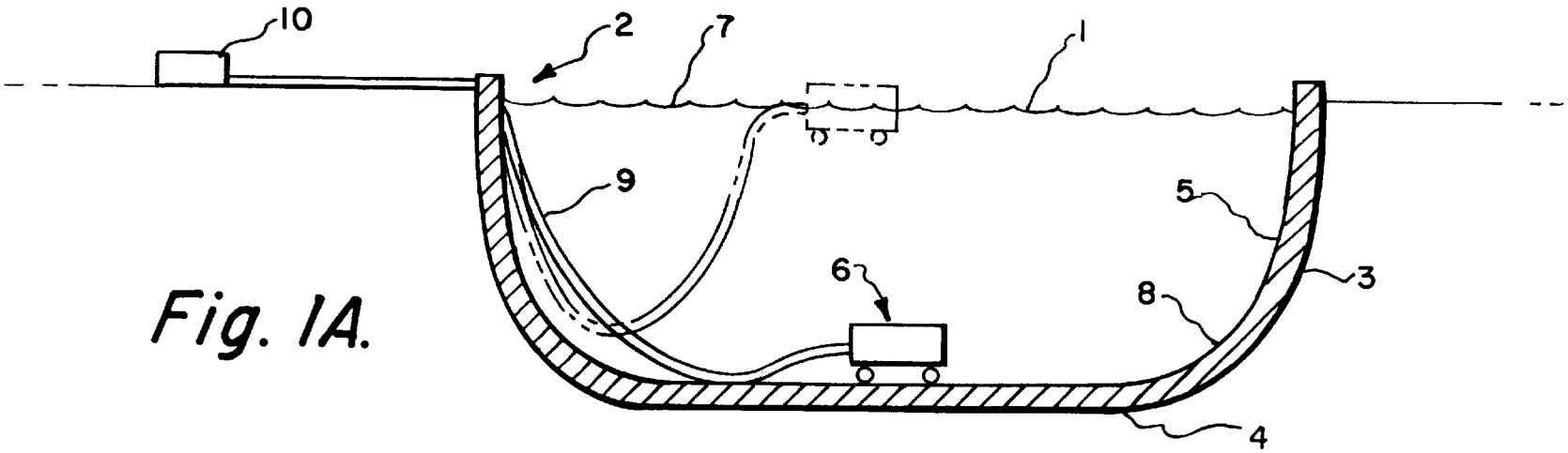
FIGS. 1A and 1B respectively schematically depict heavier-than-water and lighter-than-water embodiments of the invention powered by a flexible electric wire.
Figure 1B:
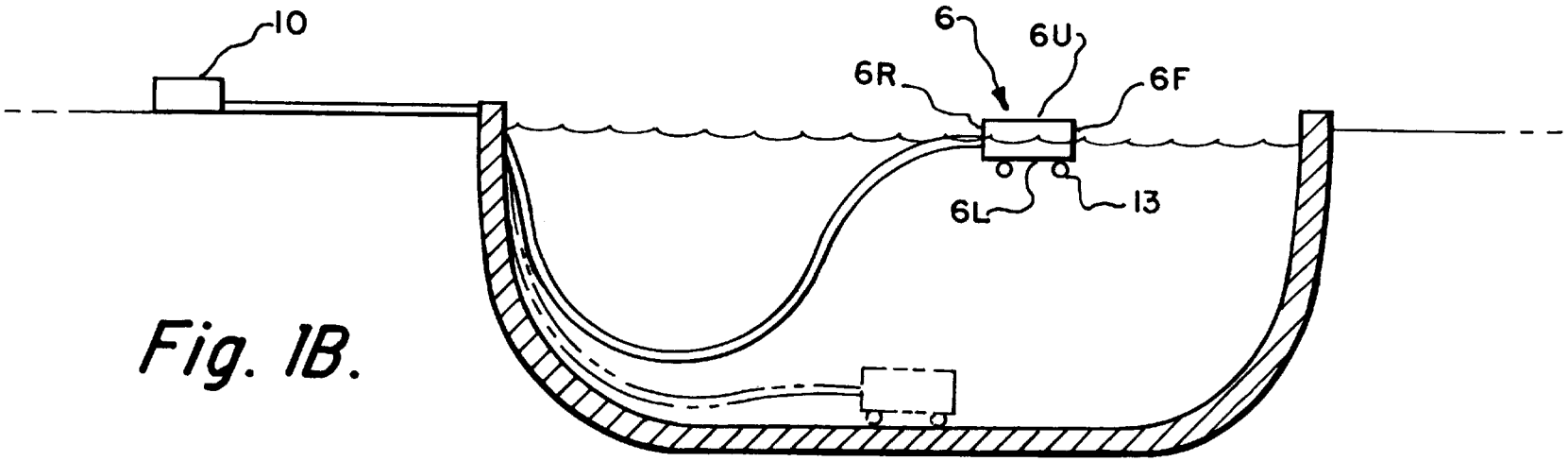

With initial reference to FIGS. 1A and 1B, the present invention is directed to a method and apparatus for cleaning a water pool 1 contained in an open vessel 2 defined by a containment wall 3 having bottom 4 and side 5 portions. Embodiments of the invention utilize a unitary structure or body 6 capable of being immersed in the water pool 1, for selective operation proximate to the water surface 7 or proximate to the interior wall surface 8.

The unitary body 6 preferably has an exterior surface contoured for efficient travel through the water. Although bodies 6 in accordance with the invention can be very differently shaped, it is intended that they be relatively compact in size fitting within a two foot cube envelope. FIG. 1A depicts a heavier-than-water body 6 which in its quiescent or rest state typically sinks to a position (shown in solid line) proximate to the bottom portion 4 of the vessel wall 3. Alternatively, the body 6 can be lifted to a position (shown in dash line) proximate to the surface 7 of water pool 1. FIG. 1B depicts a lighter-than-water body 6 which in its quiescent or rest state rises proximate to the surface 7 of water pool 1. Similarly, the body 6 can be caused to descend to the bottom 4 portion of wall 3. As will be discussed hereinafter in connection with FIGS. 2 and 3, the body 6 carries and on-board controller which in FIGS. 1A and 1B, is powered by electricity delivered via flexible wire 9 from an external electric power source 10 for controlling the states of body 6.

Figure 1C:
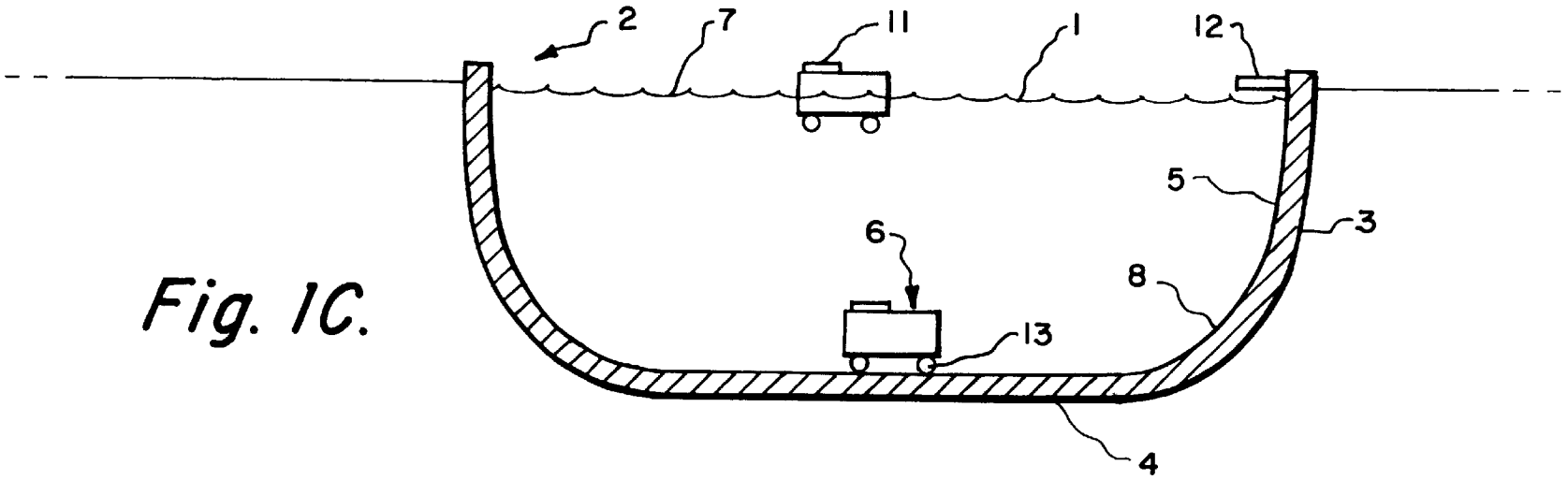
FIGS. 1C and 1D respectively schematically depict heavier-than-water and lighter-han-water embodiments powered by fully on-board electric power sources, e.g., solar cells and/or rechargeable batteries.
Figure 1D:
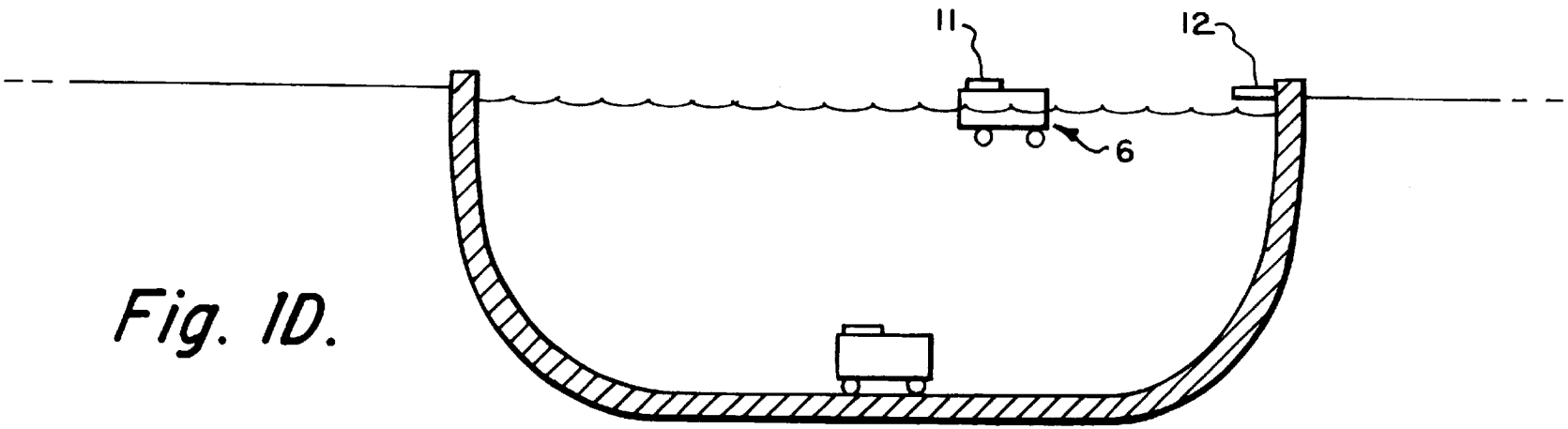

FIGS. 1C and 1D depict pool cleaner installations, respectively analogous to FIGS. 1A and 1B, except without the electric power wire 9. Rather, the body 6 in FIGS. 1C and 1D, carries an on-board electric power source, e.g., solar cells 11 and/or a battery. The battery can be recharged by the solar cell 11 and/or by electric terminals available at a docking station 12.

The body 6 is essentially comprised of upper and lower portions, 6U and 6L respectively, spaced in a nominally vertical direction, and front and rear portions, 6F and 6R respectively, spaced in a nominally horizontal direction. A traction means such as wheels 13 are typically mounted adjacent the body lower portion 6L for engaging the wall surface 8.

Embodiments of the invention are based, in part, on a recognition of the following considerations:

1. Effective water surface cleaning reduces the overall task of swimming pool cleaning since most debris in the water and on the vessel wall surface previously floated on the water surface.

2. A water cleaner capable of floating or otherwise traveling to the same place that the debris floats can capture debris more effectively than a fixed position built-in skimmer.

3. A water surface cleaner can operate by using a weir, a water entrainment device, or by scooping up debris as it moves across the water surface. The debris can be collected in a water permeable container.

4. A single unitary structure or body can be used to selectively operate proximate to the water surface in a water surface cleaning mode and proximate to the wall surface in a wall surface cleaning mode. A common debris collection container can be used in both modes.

5. The level of the body 6 in the water pool 1, i.e., proximate to the water surface or proximate to the wall surface, can be controlled by a level control subsystem capable of selectively defining either a water surface mode or a wall surface mode. The mode defined by the subsystem can be selected via a user control, e.g., a manual switch or valve, or via an event sensor responsive to an event such as the expiration of a time interval.

6. The movement of the body in the water pool can be controlled by a propulsion subsystem, preferably operable to selectively propel the body in either a forward or an alternative "redirect" direction. The direction is preferably selected via an event sensor which responds to an event such as the expiration of a time interval or an interruption of the body's forward motion.

7. A cleaning subsystem can be operated in either a water surface cleaning mode (e.g., skimming) or a wall surface cleaning mode (e.g., vacuuming or sweeping).

One or more of the aforementioned subsystems in accordance with the present invention is powered by electricity which is either delivered to the body 6 via a flexible wire 9 (FIGS. 1A, 1B) or produced on-board the body, e.g., by a solar cell and/or battery.

Figure 2:
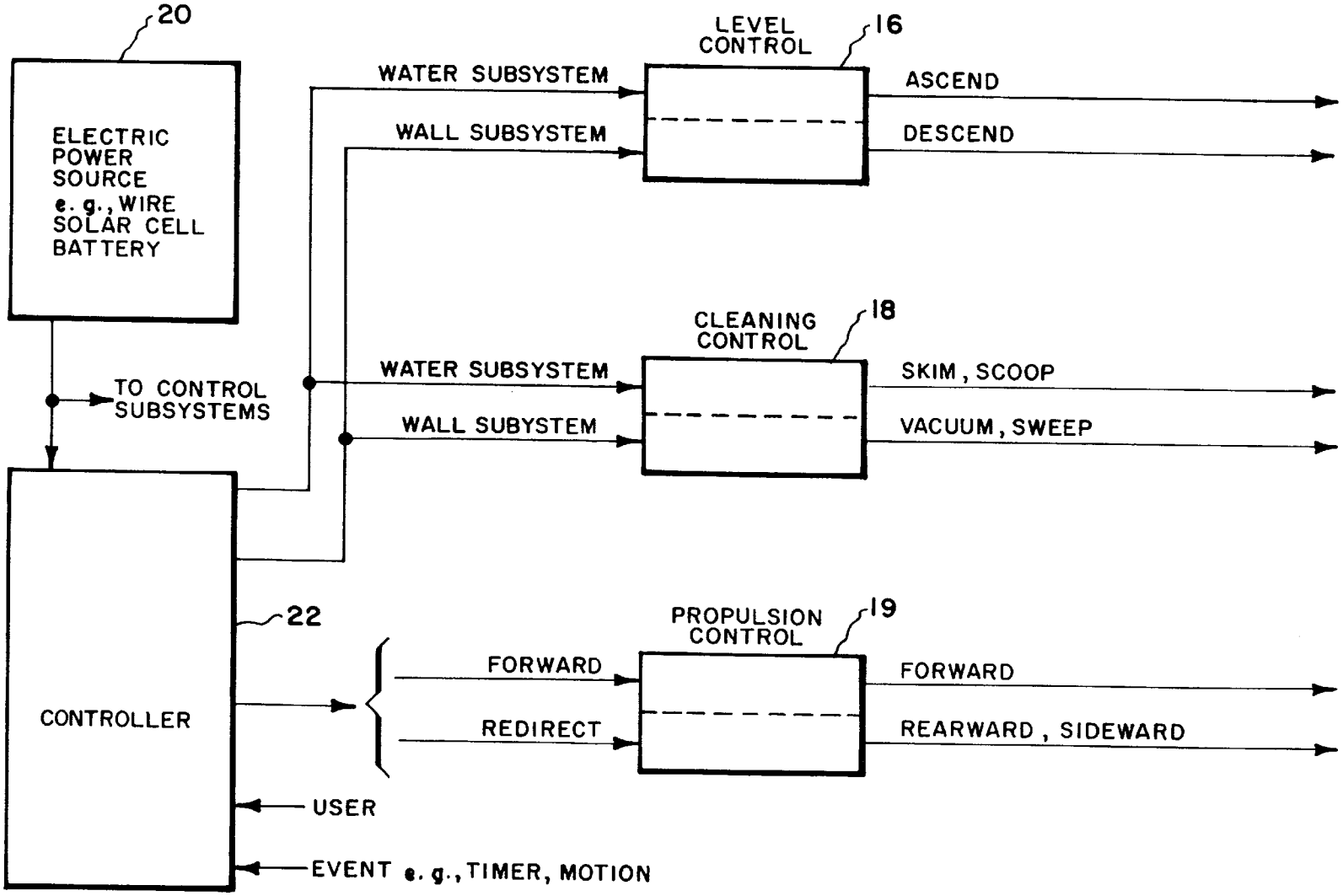
FIG. 2 is a functional block diagram generally representing the level control, cleaning control, and propulsion control subsystems utilized in preferred embodiments of the invention.

FIG. 2 shows a block diagram of the functional elements of a preferred body 6 in accordance with the present invention. The elements include a level control subsystem 16, a cleaning control subsystem 18, and a propulsion control subsystem 19. The respective subsystems are powered from an electric power source 20 which can, for example, comprise an external power source (as represented in FIGS. 1A, 1B) connected to the body via a flexible wire, or nonboard power sources such as solar cells and/or batteries (as represented in FIGS. 1C, 1D).

The electric source 20 also powers a system controller 22 which operates to define output modes (e.g., water surface or wall surface) and states (e.g., forward or redirect) in response to user and event inputs. These operating modes and states are discussed at length in applicants aforementioned parent and related applications incorporated herein by reference. To summarize briefly, the water surface and wall surface modes are alternately defined, typically controlled by a user input or by a timed event. When the controller 22 defines the water surface mode, the level control subsystem 16 places the body proximate to the water surface and the cleaning control subsystem 18 operates to collect water therefrom, as by skimming or scooping. When the wall surface mode is defined, the level control subsystem 16 places the body proximate to the wall surface and the cleaning control subsystem 18 operates to collect water therefrom, as by vacuuming or sweeping. In either case, the collected water is preferably passed through a porous debris collection container which is periodically emptied by the user. Alternatively, the collected water could be directed via a suction hose (not shown) to the pool's main filter system.

The controller 22 primarily defines the forward state which causes the propulsion control subsystem 19 to move the body 6 in a forward direction along either the water surface or wall surface to effect cleaning. However, in order to avoid lengthy cleaning interruptions, as could be caused by the body 6 getting stuck behind some obstruction, the controller preferably periodically defines the redirect state. Switching to the redirect state can be initiated by a timed event or, for example, by a sensed interruption of the body's forward motion. In the redirect state, a force is produced to move the body rearwardly and/or sidewardly. Controller 22 is also provided with a "user" input which enables the user to electively affect system operation, e.g., by overriding normal operations to compel a desired operational mode, i.e., water surface or wall surface.

Figure 3:
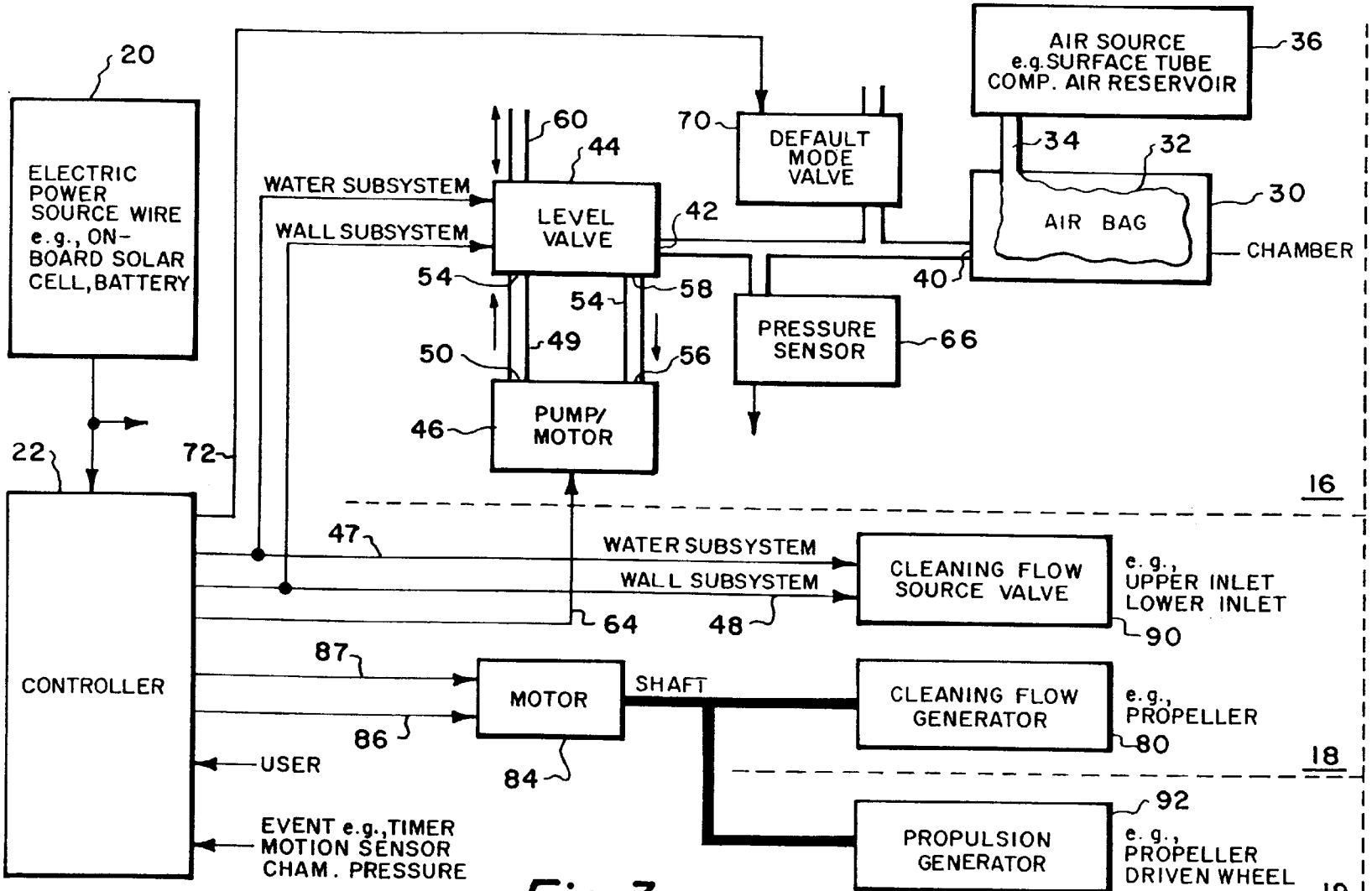
FIG. 3 is a more detailed block diagram of a preferred embodiment of the invention.

Attention is now directed to FIG. 3 which is a block diagram depicting a preferred implementation of the functional control system shown in FIG. 2. The level control subsystem 16 is implemented to modify the effective buoyancy of the body. In a preferred embodiment, a closed fluid chamber 30 containing an air bag 32 is used to modify body buoyancy. The port 34 to the air bag 32 is coupled to an air source 36 which can, for example, comprise an on-board reservoir storing compressed air or a tube extending from the body 6 to a point above the pool surface 7.

A port 40 selectively either supplies fluid, typically water, under pressure to the chamber 30 or allows fluid to flow out of the chamber, depending upon the pressure at port 42 of level valve 44. The level valve 44 is coupled to pump/motor 46 and is controlled by controller outputs 47, 48. More specifically, hose 49 couples the pressure port 50 of pump/motor 46 to inlet port 52 of level valve 44. Hose 54 couples the suction port 56 of pump/motor 46 to outlet port 58 of level valve 44. Level valve 44 is also provided with a port 60 which is open to pool water.

A heavier-than-water body 6 can be floated to the surface by extracting water from chamber 30 and allowing the volume of air in bag 32 to expand. In order to extract water from chamber 30, the level valve 44 is operated in the water surface mode commanded by output 47 to couple port 42 to pump/motor suction port 56. In this state, the level valve directs the positive pressure output from the pump/motor supplied to port 52 out through open port 60.

In the wall surface mode commanded by output 48, water is supplied under pressure to chamber port 40 to force air out of the bag 32, either back into the aforementioned compressed air reservoir or out through the surface tube. To supply water under pressure to chamber port 40, level valve 44 is operated to couple the pressure port 50 of pump/motor 46 to level valve port 42. In this state, port 60 operates as a water source enabling water to be pulled through the level valve and hose 54 into the suction port 56 of the pump/motor 46.

The two states of the level valve 44 are controlled by controller outputs 47, 48. The energization of the pump/motor 46 is controlled by controller output 64.

It is preferable that the level control subsystem 16 also include a pressure sensor 66 for sensing the pressure level in the tube between level valve port 42 and chamber port 40. The output of the pressure sensor 66 comprises one of the event inputs to controller 22 to cause it to de-energize pump/motor 46 when the pressure is out of limits. The implementation of the level control subsystem 16 preferably also includes a default mode valve 70. In normal operation, this valve is closed as a consequence of a signal provided by controller output terminal 72. However, in the event of electrical failure, the valve 70 defaults to an open position which can, for example, enable the compressed air source to supply air to the bag 32 to allow the body 6 to ascend, even in the absence of electrical power. If a surface tube is used, air can escape via the tube to cause the body 6 to sink.

The cleaning control subsystem 18 is implemented by a cleaning flow generator 80, e.g. a propeller which pulls water into the body, as will be explained in greater detail in connection with FIGS. 4–6, and runs it through a porous debris collection container. The cleaning flow generator 80 is driven by the output shaft (and appropriate gearing) of a motor 84. The energization and direction of the motor is controlled by controller outputs 86, 87. Preferred embodiments of the invention include an upper inlet for collecting water from the pool water surface and a lower inlet for collecting pool water from proximate to the wall surface. In order to enable the cleaning flow to be collected from either one surface or the other, a cleaning flow source valve 90 is provided which in controlled by the aforementioned controller outputs 47, 48.

The propulsion control subsystem 19 is implemented by a propulsion generator 92 which can comprise a propeller, a driven traction wheel, or a nozzle outlet flow. The propulsion generator 92 can be driven by the aforementioned motor 84. The motor 84 can be driven bidirectionally via the aforementioned controller outputs 86 and 87. Thus, by driving the motor 84 in a forward direction, the propulsion generator 92 will produce a flow to move the body 6 in a forward direction. By reversing the motor direction, the propulsion generator 92 will be driven in an opposite direction to redirect the movement of the body, for example to cause it to back up.

Figure 4:
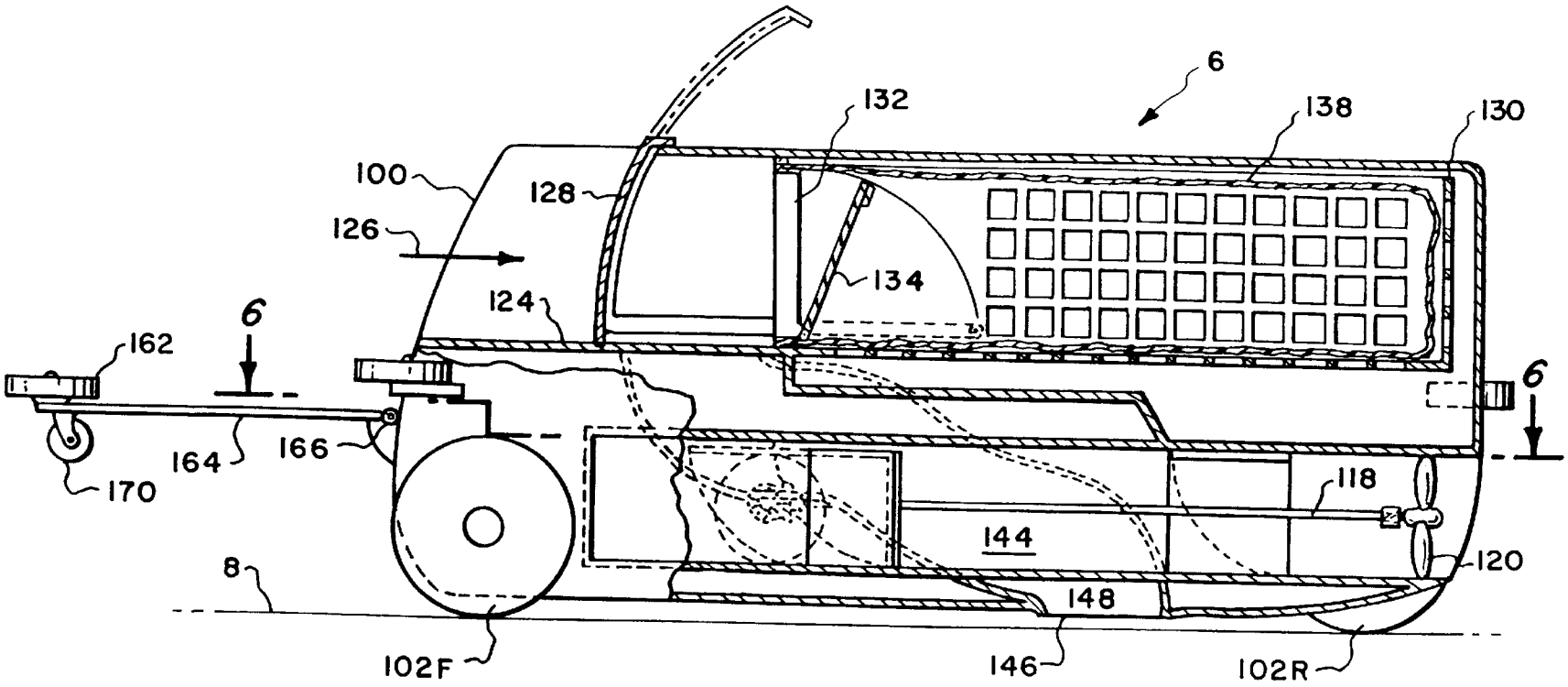
FIG. 4 comprises a side view of a first structural embodiment of the invention cutaway to the right of line C to show internal body detail.
Figure 5:
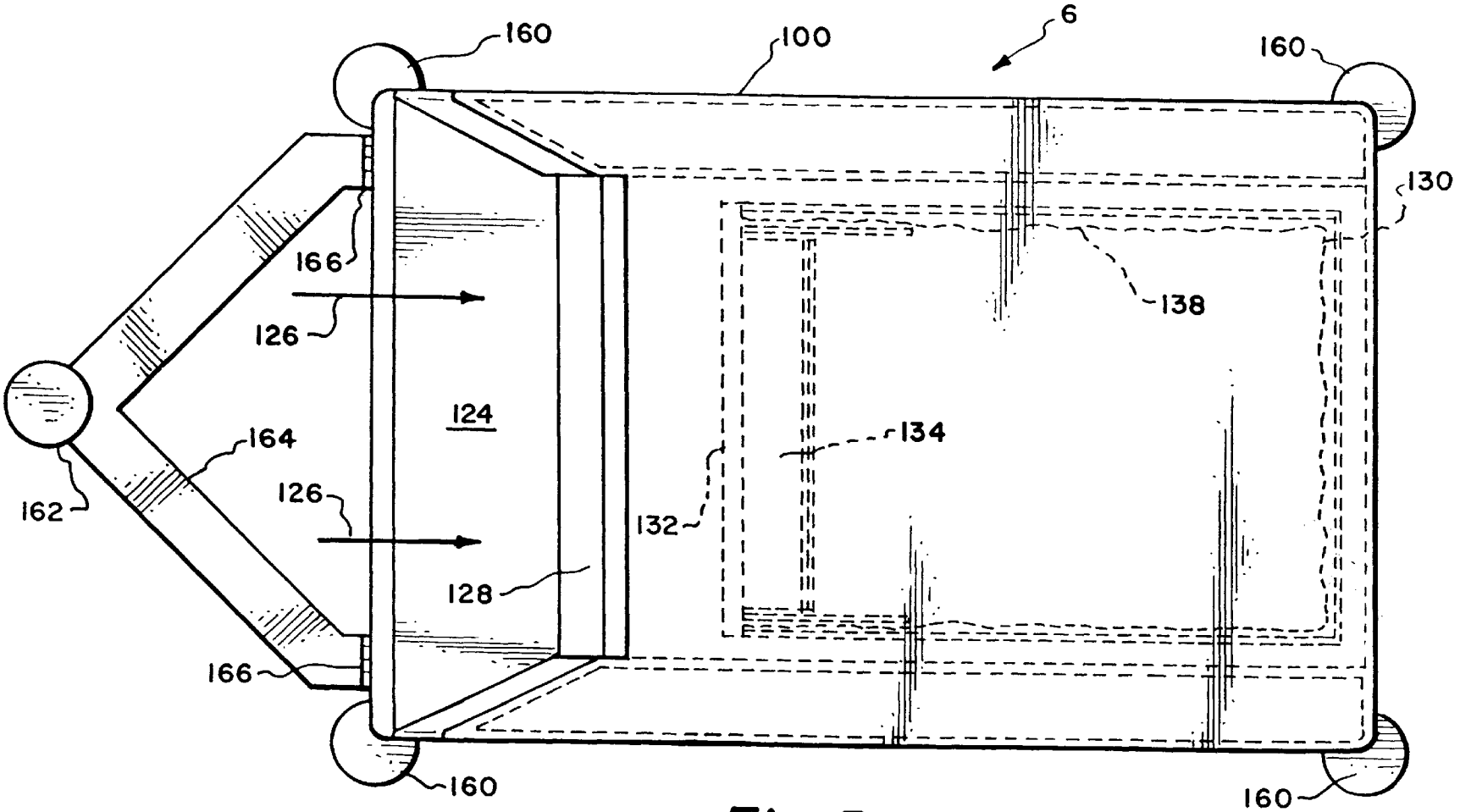
FIG. 5 comprises a top view of the body of FIG. 4.
Figure 6:
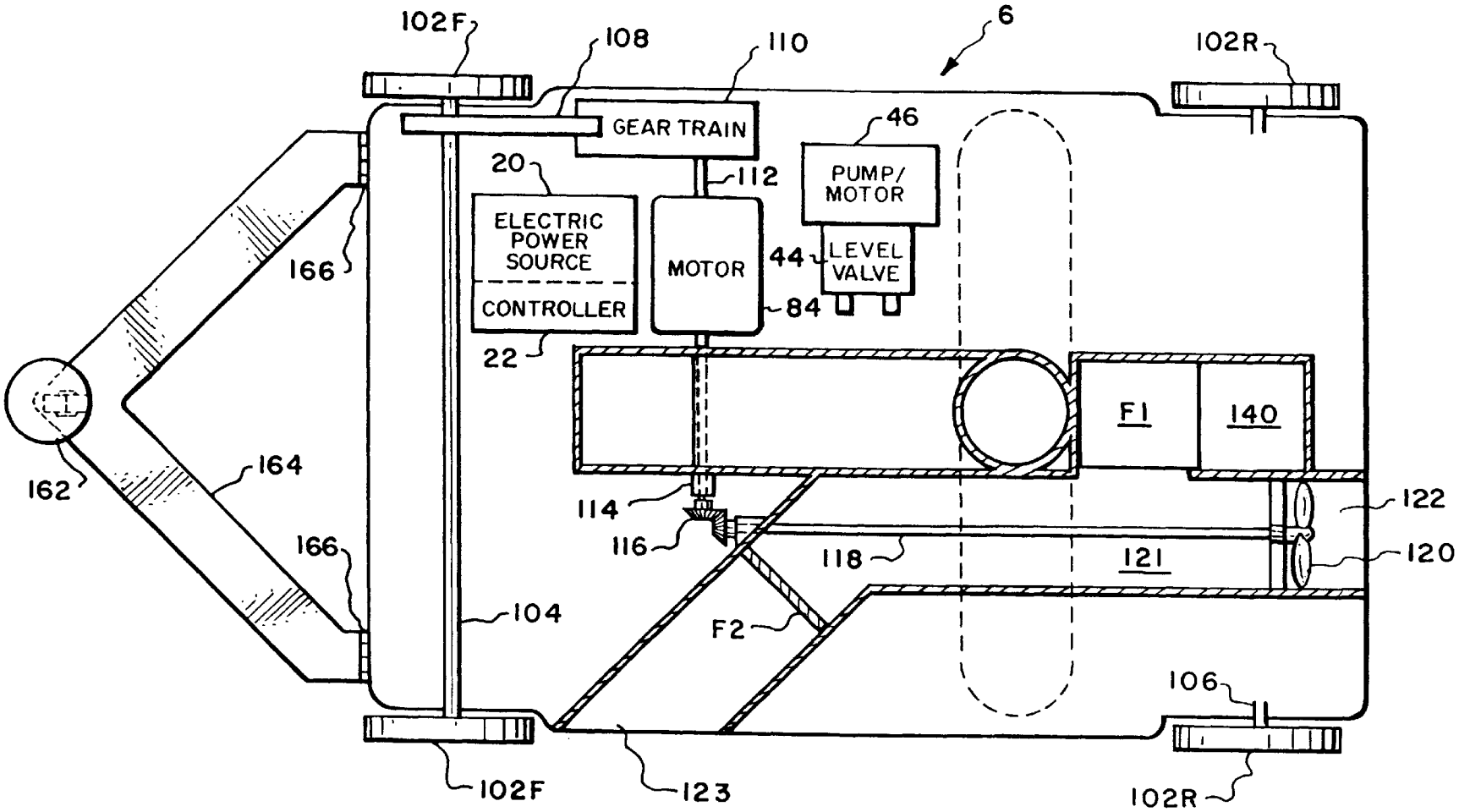
FIG. 6 comprises a sectional view taken substantially along the plane 6—6 of FIG. 4.

Attention is now directed to FIGS. 4, 5, 6 which illustrate a preferred structural embodiment of body 6 consistent with the aforediscussed block diagram of FIG. 3. The body 6 essentially comprises a rectangular housing 100 supported on multiple traction wheels 102. Front wheels 102F are mounted on a common drive axle 104. Rear wheels 102R are mounted on idle spindles 106. Drive axle 104 is coupled via gear 108 and gear train 110 to output shaft 112 of aforementioned drive motor 84. Drive motor 84 is additionally coupled via shaft 114 and bevel gear 116 to propeller drive shaft 118. When operating in the forward state, shaft 118 drives propeller 120 in a first direction to draw water from propeller chamber 121 to discharge the water rearwardly from opening 122 to produce forward body motion. To operate in the backup or redirect state, shaft 118 drives propeller 120 in a second opposite direction to pull water into opening 122 to discharge it via opening 123 in a forward/sideward direction to produce rearward/sideward motion. To achieve correct directional flow through openings 122 and 123, flap elements F1 and F2 are provided. Flap elements F1 and F2 will be discussed further hereinafter, but at this juncture it is helpful to know that in the forward state, F1 is open and F2 is closed and in the redirect state, F1 is closed and F2 is open. The positions of these elements are determined by the direction of flow produced by propeller 120.

The body 6 defines an internal cavity which, in addition to housing the motor 84, also accommodates the aforementioned pump/motor 46 and level valve 44. The body 6 also carries the electric power source 20 which, as previously noted, can constitute a solar cell, a battery, or the terminals of a flexible wire extending to an external power source. Additionally, as shown in FIG. 6, the body 6 also houses the aforediscussed controller 22.

The body 6 is configured to move forwardly along either the pool water surface or wall surface. When at the water surface, forward propulsion is achieved primarily by the outflow produced by rotation of propeller 120. When at the wall surface, forward propulsion is primarily achieved by the driven front wheels 102F.

The body 6 is configured so that when operating at the water surface, pool water flows over deck 124 as represented by the flow arrows 126. In the water surface mode, the gate 128 (cleaning flow source valve 90 in FIG. 3) is raised to the position shown in dotted line in FIG. 4. As a consequence, surface water 126 will flow into basket 130 through the open basket mouth 132. The inflow 126 into basket 130 will open flap valve 134 which is provided to prevent reverse outflow from the basket 130. The basket 130 preferably contains a removable porous debris collection container or bag 138. The water 126 flowing over the deck 124 into the collection bag 138 leaves its debris in the bag and then passes out through the basket, entering port 140. If in this forward state, the flow moves past open flap F1 and into the propeller supply chamber 121. The propeller 120 operates to pull water from chamber 121 and discharge it rearwardly to provide forward propulsion.

In the wall surface cleaning mode, gate 128 is closed, i.e. down, and the propeller 120 operates to pull water in from vacuum port 146 proximate to the wall surface 8. This flow travels up passage 148 to enter collection bag 138 via mouth 132. After passing through the bag and basket 130, it flows past open flap F1 into chamber 121 for rearward discharge by propeller 120.

When in the redirect state, the propeller 120 is rotated in the opposite direction to draw water in via opening 122. This direction of flow acts to close flap F1 to prevent reverse flow through the basket 130 and bag 138 and open flap F2 is discharge rearwardly and sidewardly from opening 123.

In order to facilitate movement of the body 6 around obstructions, the body is preferably provided with horizontally oriented guide wheels 160 projecting from its corners. Additionally, a forwardly projecting guide wheel 162 is mounted on bracket 164 hinged at 166 to the body 6. The guide wheel 162 primarily functions at the water surface to engage the pool wall and facilitate movement of the body around obstructions. A caster wheel 170 is preferably mounted beneath the guide wheel 162 for engaging and riding over contoured surfaces when the unit is operating in the wall surface mode.

Figure 7:
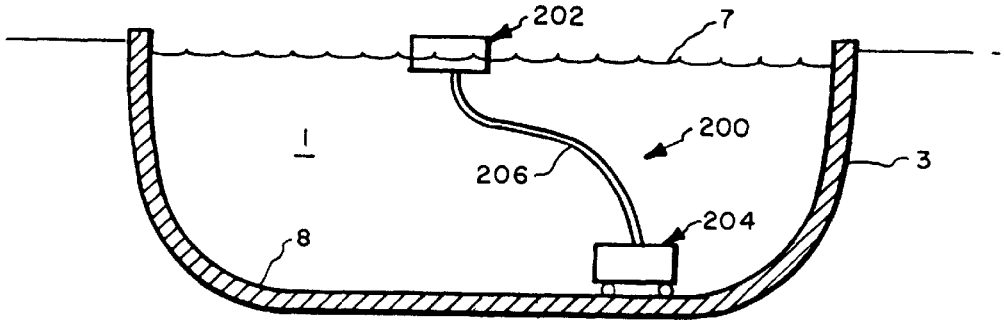
FIG. 7 is a schematic illustration of a further embodiment of the invention employing separate top and bottom units tethered together.

Attention is now directed to FIG. 7 which illustrates an alternative embodiment 200 of the invention comprised of separate top and bottom units 202 and 204 connected by a conduit 206 which is preferably flexible. The top unit 202 is configured to reside, e.g., float, proximate to the surface 7 of water pool 1. The bottom unit 204 is configured to reside proximate to the interior wall surface 8 of containment wall 3. The bottom unit 14 can be supported on a suitable traction means such as wheels 13 which engage the wall surface 8.

In accordance with the embodiment 200, at least one of the units 202 and 204 includes a propulsion and/or cleaning subsystem adapted to be driven by electric energy supplied from a suitable power source (not shown in FIG. 7). The power source can comprise solar cells and/or rechargeable batteries and/or a wire extending from an external power source, e.g., deck mounted. The power source can directly provide electric energy to both units 202 and 204 but preferably, only one of the units is directly powered and energy is supplied to the other unit via conduit 206.

Figure 8:
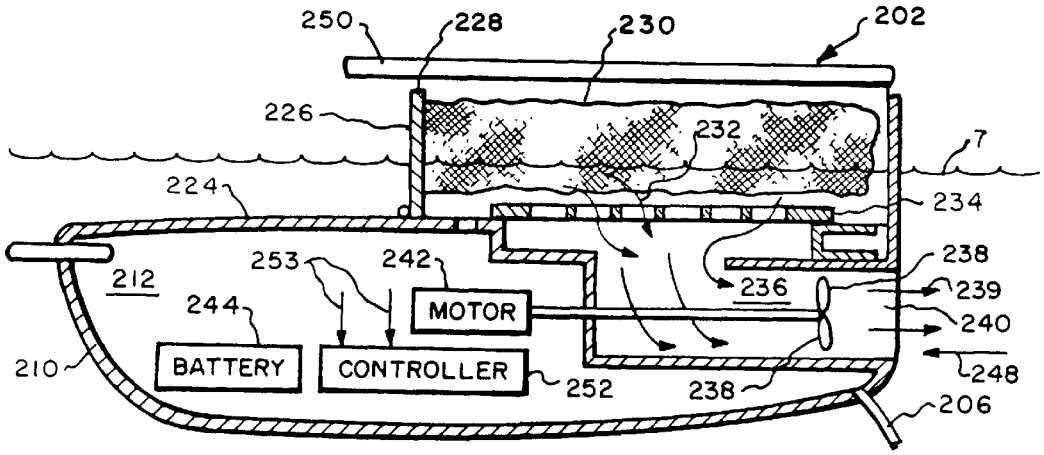
FIG. 8 is a schematic side sectional view of an exemplary top unit for use in the embodiment of FIG. 7.

FIG. 8 schematically depicts a preferred embodiment of a top unit 202 which is comprised of a housing 210 defining an interior volume 212. The housing is configured similarly to that discussed in connection with FIG. 4 and defines a deck 224 leading to an inlet or mouth 226 defined by frame 228. Mouth 226 opens into a removable porous debris collection container or bag 230 which receives water and debris flowing over deck 224 into mouth 226. Water flows out of container 230, as represented by arrows 232, through apertured plate 234 and into chamber 236. A propeller 238 is mounted in chamber 236 to pull water through apertured plate 234 and discharge a stream 239 rearwardly through opening 240. The propeller 238 is driven by an on-board electric motor 242 which is preferably powered by an on-board battery 234. The propeller action pulls water from debris container 230 past apertured plate 234 for discharge through opening 240. The discharged water stream 239 produces a propulsion force 248 which acts to propel the housing 210 forwardly, i.e., to the left as depicted in FIG. 8.

The battery 244 is preferably rechargeable, for example, by onboard solar cells or by a docking station located adjacent to wall surface 8. FIG. 8 depicts an exemplary solar cell 250 carried by housing 240 above the water surface 7. The battery 244 functions not only to power motor 242 but also to provide electric energy to a controller 252, analogous to aforediscussed controller 22. It will be recalled that the aforediscussed controller 22 operates a level control subsystem to alternately define water surface and wall surface cleaning modes for the unitary body 6. In the embodiment depicted in FIGS. 7–10, a level control subsystem is not required to alternately raise and lower a unitary body because unit 202 always resides proximate to the water surface and unit 204 always resides proximate to the wall surface. Still, however, the controller 252 preferably functions to alternately define a wall surface mode in which unit 204 is energized and a water surface mode in which unit 202 is energized. Alternatively, the units 202 and 204 can operate concurrently. The controller 252 is preferably responsive to "event" and "user" inputs 253 in the same manner as controller 22 depicted in FIGS. 2, 3. Typically event inputs are initiated by a timer, and/or by a motion sensor, which define major and minor operating phases. The user input enables a system user to override normal system operation to compel a particular operational mode. For example, if an unusually large amount of debris is on the pool surface, the user may want to maintain the top unit 202 energized (i.e., water surface mode) until the water surface is fully clean.

As will be seen, the controller 252 of FIG. 8 not only controls motor 242 and the propulsion of unit 202, it can via conduit 206, similarly control the operation of unit 204. Conduit 206 is preferably configured to transfer electric power and/or control signals between the units 202 and 204. Alternatively, the conduit 206 can be configured to provide power and/or control signals via fluid pressure, e.g. water or air.

Figure 9:
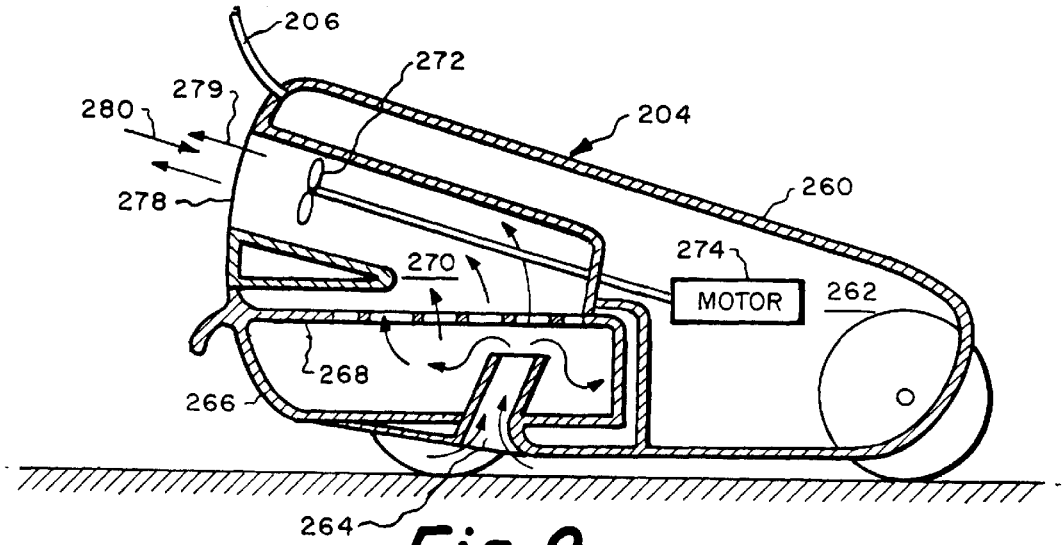
FIG. 9 is a schematic side sectional view of an exemplary bottom unit for use in the embodiment of FIG. 7.

Attention is now directed to FIG. 9 which schematically depicts a side sectional view of a preferred bottom unit 204. Unit 204 is comprised of a housing 260 defining an interior volume 262. The housing 260 defines a water inlet 264 which opens into a debris collection container 266. The container 266 includes a porous wall 268 which enables water to pass therethrough into chamber 270. Chamber 270 includes a propeller 272 mounted to be driven by electric motor 274. Power and/or control signals from top unit 202 are communicated to unit 204 via aforementioned conduit 206. Energization of motor 274 rotates propeller 272 to pull water in through inlet 264, and through debris container 266, into chamber 270 for discharge through opening 278. The discharge 279 from opening 278 produces a force acting to propel the unit 204 to the right, as depicted in FIG. 9, as represented by arrow 280.

Figure 10:
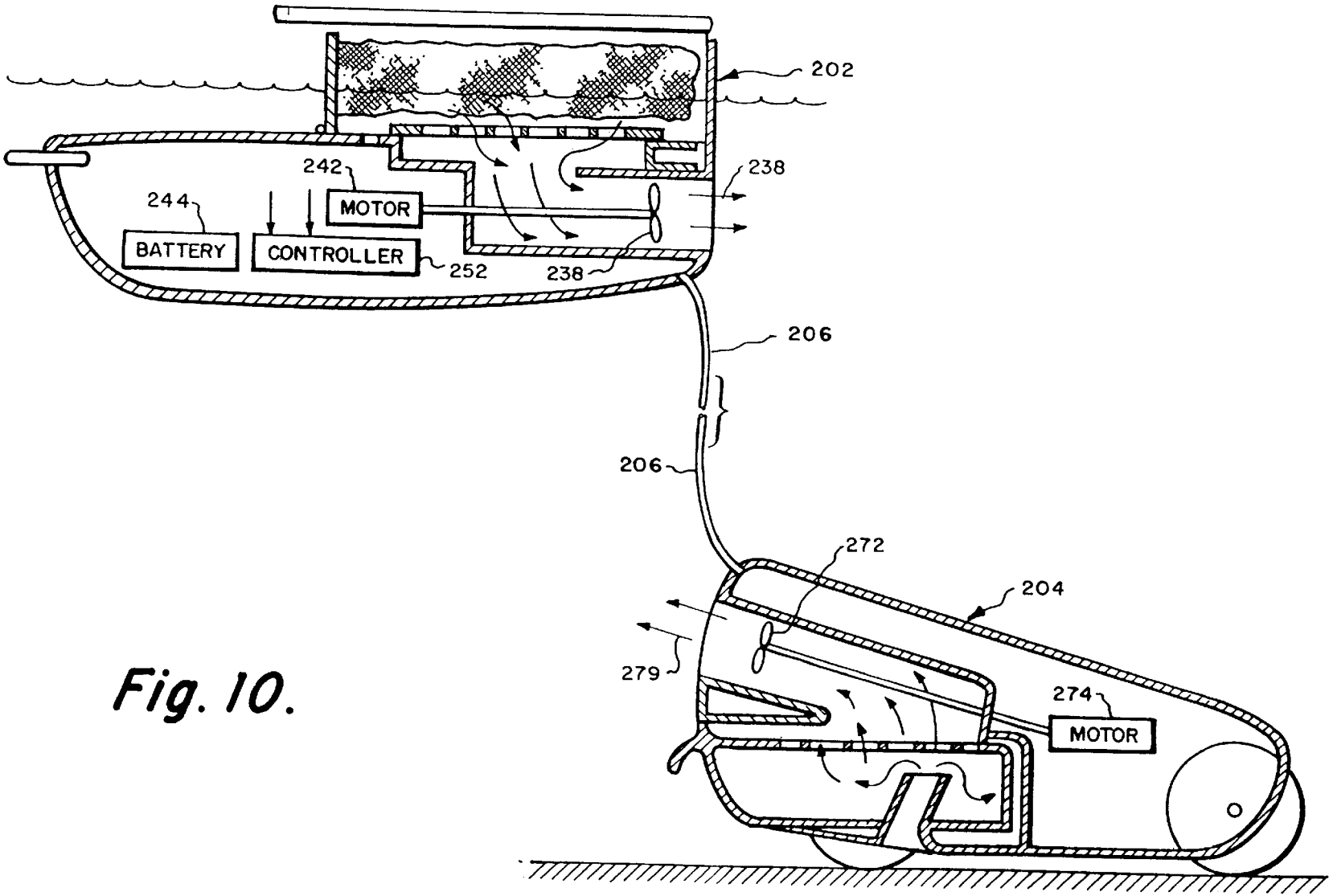
FIG. 10 depicts a preferred manner of tethering the top and bottom units for forward propulsion in respectively different directions to enable the tethered pair to free itself from obstructions.

Attention is now directed to FIG. 10 which illustrates a preferred manner of tethering units 202 and 204 together via conduit 206. Conduit 206 is structurally configured to be flexible but also to exhibit sufficient rigidity to maintain units 202 and 204 oppositely oriented. That is, unit 202 is preferably oriented so that its propeller 238 discharges a flow 239 to the right, as depicted in FIG. 10, so as to generate a propulsion force to the left. On the other hand, propeller 272 of bottom unit 204 discharges a stream 279 to the left, as depicted in FIG. 10 to generate a propulsion force to the right. By oppositely directing the discharge from units 202 and 204, the tethered pair of units is able to avoid getting trapped behind obstructions in the pool. For example, assume the pair is operating in a wall surface cleaning mode with the unit 204 being propelled to the right (as viewed in FIG. 10) and with the unit 202 being pulled behind it via the force transferred by the conduit 206. If the unit 204 gets trapped behind an obstruction as it travels along its wall surface path, it will be extricated from this situation as soon as the controller switches the system to the water surface cleaning mode. That is, once the water surface cleaning mode is defined, then the propulsion force produced by bottom unit 204 will terminate and the propulsion force produced by top unit 202 will be initiated moving unit 202 to the left (as viewed in FIG. 10) pulling the unit 204 along with it.

From the foregoing, it should now be appreciated that multiple electrically powered system embodiments have been disclosed herein for automatically cleaning the surface of a water pool and the surface of a containment wall containing the pool.

What is claimed is:

1. Apparatus for use with a containment wall having bottom and side portions containing a pool of water having a surface for cleaning the surface of said water and the surface of said wall, said apparatus comprising:

a unitary body capable of being immersed in said pool water;

an electric power source including a battery;

a level control subsystem responsive to said power source for producing a vertical force to selectively place said body either (1) proximate to said water surface or (2) proximate to said wall surface below said water surface;

at least one pool water inlet in said body; and a propulsion control subsystem responsive to said power source for selectively moving said body either (1) along a path adjacent to said water surface for collecting pool water through said inlet from adjacent to said water surface or (2) along a path adjacent to said wall surface for collecting pool water through said inlet from adjacent to said wall surface.

2. The apparatus of claim 1 wherein said battery is rechargeable; and a solar cell carried by said body for recharging said battery.

3. The apparatus of claim 1 wherein said battery is rechargeable; and a docking station for recharging said battery.

4. The apparatus of claim 1 further including user means for selectively causing said level control subsystem to place said body (1) proximate to said water surface or (2) proximate to said wall surface.

5. Apparatus for cleaning the surface of a containment wall configured to contain a pool of water having a water surface, said apparatus comprising:

a unitary body:

a rechargeable electric power source carried by said body configured to allow recharging by a docking station; and a control system carried by said body and powered by said power source, said control system including:

a propulsion subsystem for selectively moving said body along a path adjacent to said wall surface; and a docking station mounted proximate to said containment wall for recharging said power source.

6. Apparatus for use with a containment wall having bottom and side portions containing a pool of water having a water surface, for cleaning the surface of said water and the surface of said wall, said apparatus comprising:

a first unit configured to travel proximate to said water surface;

a second unit configured to travel proximate to said wall surface;

a power source for supplying electric energy to at least one of said first and second units;

a conduit physically connecting said first and second units for transferring energy therebetween; and a propulsion subsystem carried by at least one of said first and second units and responsive to electric energy supplied thereto for propelling said first unit along a travel path proximate to said water surface and/or said second unit along a travel path proximate to said wall surface.

7. The apparatus of claim 6 wherein said conduit is configured to transfer electric energy.

8. The apparatus of claim 6 wherein said first unit includes a pool water inlet; and means for removing debris from pool water collected through said first unit inlet.

9. The apparatus of claim 6 wherein said second unit includes a pool water inlet; and means for removing debris from pool water collected through said second unit inlet.

10. The apparatus of claim 6 wherein said propulsion subsystem includes a motor driven propeller.

11. The apparatus of claim 10 further including a solar cell carried by said first unit for recharging said battery.

12. The apparatus of claim 6 wherein said power source includes at least one battery carried by at least one of said first and second units.

13. The apparatus of claim 6 wherein said power source includes a wire connected to an energy source beyond said containment wall.

14. The apparatus of claim 6 wherein said power source comprises a battery; and further including a docking station for recharging said battery.

15. The apparatus of claim 6 further including:

a controller for selectively energizing said first unit and/or said second unit.

16. The apparatus of claim 15 wherein said controller is responsive to an event input for controlling the selective energization of said first and second units.

17. The apparatus of claim 15 wherein said controller is responsive to a user input for controlling the selective energization of said first and second units.

* * * * *